United States Patent [19]

Orenstein

[11] 4,413,311

[45] Nov. 1, 1983

[54] CONNECTION SYSTEM FOR JOINING ILLUMINATED MODULES

[76] Inventor: Philip Orenstein, 34-42 12 St., Long Island, N.Y. 11106

[21] Appl. No.: 298,303

[22] Filed: Sep. 1, 1981

[51] Int. Cl.[3] ..... F21S 3/00

[52] U.S. Cl. ..... 362/219; 362/145; 362/147; 362/153; 362/223; 362/224; 362/230; 362/234; 362/249; 362/252; 362/263; 362/267; 362/311; 362/362; 362/375; 362/806; 362/812

[58] Field of Search ..... 362/219, 223, 224, 230, 362/234, 145, 147, 153, 249, 252, 263, 267, 311, 362, 375, 806, 812

[56] References Cited

U.S. PATENT DOCUMENTS

| | | | |
|---|---|---|---|
| Re. 18,679 | 12/1932 | Hotchner . | |
| 1,689,485 | 10/1928 | Hendry | 362/806 |
| 1,839,479 | 1/1932 | Hartman . | |
| 1,984,986 | 12/1934 | Prouty | 362/806 |
| 2,181,889 | 12/1939 | Hanson . | |
| 2,214,447 | 9/1940 | Bave . | |
| 2,296,893 | 9/1942 | Austin . | |
| 2,565,635 | 8/1951 | Thuernau | 362/806 |
| 3,569,689 | 3/1971 | Nestrock | 362/146 |
| 4,161,769 | 7/1979 | Elliott | 362/146 |

*Primary Examiner*—Stephen J. Lechert, Jr.

*Attorney, Agent, or Firm*—Martin P. Hoffman; Mitchell B. Wasson; Charles W. Fallow

[57] ABSTRACT

A connection system comprising a variety of metal connectors, a plurality of illuminated modules insertable into the connectors, and electrical leads hidden within the connectors to electrically join the modules in series relationship, and a step-up transformer for supplying the voltage needed to energize the plurality of modules. Each connector has a hollow body adapted to receive at least one illuminated module. Each illuminated module includes a rigid, transparent plastic sleeve with an annular collar at each end of the sleeve; a gas filled tube is retained in the sleeve by the collars. A foot with a mounting flange is operatively associated with some of the connectors to firmly support an assembled plurality of illuminated modules. The connectors and illuminated modules can be assembled into diverse configurations for applications previously unsuited for gas filled tubes, such as neon.

4 Claims, 11 Drawing Figures

CONNECTION SYSTEM FOR JOINING ILLUMINATED MODULES

BACKGROUND OF THE INVENTION

1. Field of the Invention

This invention relates generally to a connection system for mechanically and electrically joining together a plurality of illuminated modules. More particularly, this invention relates to hollow, tubular metallic connectors that receive illuminated modules, such connectors and modules being secured together in diverse configurations to produce utilitarian illuminated assemblies.

2. Description of the Prior Art

Tubes filled with inert gases, such as neon, argon, xenon, etc. or combinations of such gases, have been used widely for several years in decorative illuminating systems, such as signs of diverse sizes and shapes, displays, automotive lights, etc. The signs and displays have met with commercial success because of their low operating costs, extended life span, the relative ease with which the tubes can be bent or molded into unique shapes, as well as the wide variety of colors that can be obtained by selecting different compositions of the gas to be sealed in the tubes. Representative gas filled tubes utilized for signs, displays, and lighting systems are shown in U.S. Pat. No. Re. 18,679, granted to Fred Hotchner, U.S. Pat. No. 1,984,986 granted to Willis A. Prouty, U.S. Pat. No. 2,181,889 granted to Earl C. Hanson, U.S. Pat. No. 2,214,447 granted to Edwin B. Bave, U.S. Pat. No. 2,296,893 granted to Harold J. Austin, and U.S. Pat. No. 2,565,635 granted to Henry A. Thuernau.

The forming of gas filled tubes, and the bending of such tubes into imaginative shapes, required a skilled artisan. Also, each sign or display was individually crafted, and these factors increased the costs associated with the gas filled tubes. The bulkiness of the transformer needed to supply the power to ignite the gas in each tube was also a drawback, and the fragility of each tube limited the applications for which these gas filled tubes might be employed successfully.

SUMMARY

Thus, with the known shortcomings of gas filled tubes clearly in mind, the instant invention contemplates a connection system that mechanically, and electrically, joins together a plurality of illuminated modules into a desired configuration. The connection system is characterized by (1) unique metal connectors, (2) illuminated modules including gas filled tubes, and (3) hidden leads disposed within the metal connectors to energize the modules from a remote power source.

The connectors are formed in a variety of sizes and shapes, but each connector is executed in a highly polished metal, has a hollow, tubular body to receive at least one end of an illuminated module, and may have one or more hollow arms to receive additional illuminated modules. Each module comprises a rigid, transparent plastic sleeve with an annular collar situated at each end of the sleeve; a gas filled tube, such as a neon tube, is retained within the sleeve by the annular collars. A foot with a mounting flange is operatively associated with some of the connectors to firmly support the assembled plurality of illuminated modules. The leads that extend from module to module to deliver power thereto are hidden with the hollow body of the connector that receives the opposing ends of adjacent illuminated modules.

The above described connection system combines the desirable attributes of gas filled tubes, such as attractiveness, low cost of operation, extended operating life, different color choices, etc. with sturdy components that protect the tubes from damage despite repeated handling. Additionally, the connection system employs hollow metal connectors to hide the electrical cable extending between adjacent tubes, thus enhancing the aesthetic appeal of the assembly of illuminated modules. Exemplary applications for the illuminated modules may be door pulls on sliding glass doors, or on emergency doors, hand rails in elevators or on flights of stairs, towel racks, outlining exit doors, room dividers, lighting fixtures, etc.

Furthermore, the connection system lends itself to rapid joinder of the illuminated modules, so that the resulting illuminated assembly may be made and installed at a competitive price by relatively unskilled workers.

In addition to opening up new avenues for the application of gas filled tubes, the instant invention is compatible with known applications for gas filled tubes. Furthermore, although the tubes utilized with the connection system are not bent, the connection system can be used to readily and inexpensively approximate sizes, shapes, etc. that were previously only obtainable through the exercise of significant skill by the artisan.

Yet other advantages attributable to the instant connection system will become apparent to the skilled artisan when the attached drawings are construed in harmony with the following description of the invention.

DESCRIPTION OF THE PREFERRED EMBODIMENT

Figure 1:
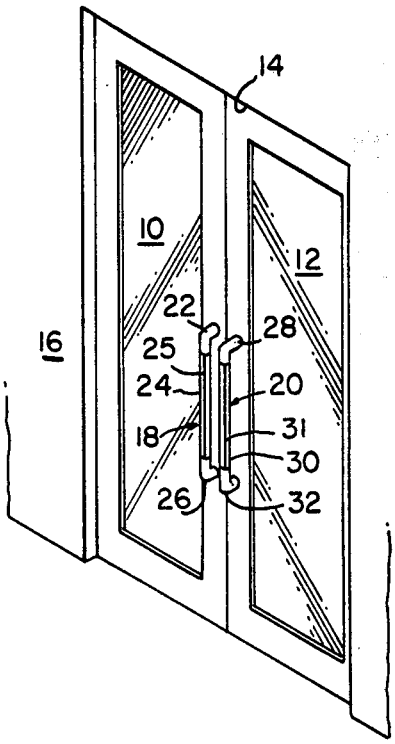
FIG. 1 is a perspective view of an illuminated door pull assembly constructed in accordance with the principles of the present invention.

Turning now to the drawings, wherein similar reference numerals are employed to identify similar components, FIG. 1 depicts a set of doors 10,12 mounted within a jamb 14 formed in wall 16. The doors are mounted for pivotal movement in a vertical plane, and are secured to the jamb by conventional hinges (not shown). A door pull assembly 18 constructed in accordance with the principles of this invention is used to open door 10, while a similar door pull assembly 20 is used to open door 12. Door pull assembly 18 includes, inter alia, a first right angled connector 22, an illuminated module including cylindrical, transparent plastic sleeve 24 which encases a thin gas filled tube 25, and a second right angled connector 26. Door pull 20 includes, inter alia, a first right angled connector 28, an illuminated module including cylindrical, transparent plastic sleeve 30, which encases a thin gas filled tube 31, and a second right angled connector 32. The gas filled tubes 25,31 within the door pulls 18,20 are illuminated from a remote power source (not shown) to clearly demarcate the location of the doors 10,12 at all times, even in the dark or under low light conditions.

Figure 2:
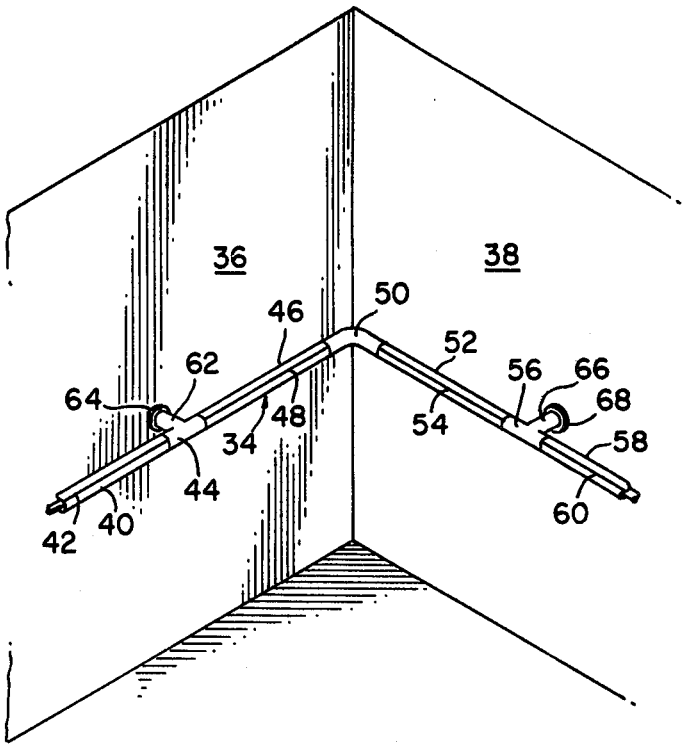
FIG. 2 is a perspective view of an illuminated hand rail assembly constructed in accordance with the principles of the present invention.

FIG. 2 shows a fragmentary view of an illuminated hand rail assembly 34 constructed in accordance with the principles of the invention; the rail assembly 34 extends around the interior walls 36,38 of an elevator at waist height. The hand rail assembly 34 comprises a first illuminated module including transparent plastic sleeve 40 that encases a first gas filled tube 42, a first straight-through two-way connector 44, a second illuminated module including transparent plastic sleeve 46 that encases a second gas filled tube 48 and a two-way, right angled connector 50 that fits into the corner between walls 36,38. The hand rail assembly further includes a third illuminated module including sleeve 52 that encases a gas filled tube 54, another two-way straight-through connector 56, and a fourth illuminated module including a sleeve 58 that encases a gas filled tube 60, etc.

A foot 62 projects rearwardly from connector 44, and a mounting flange 64 is located at the free end of the foot 62. The flange 64 is bolted, nailed, or otherwise secured to the wall 36 so that the connector 44 is retained in a fixed, stable position. Similarly, a foot 66 projects rearwardly from connector 56, and a mounting flange 68 is located at the free end of the foot. The flange 68 is secured to the wall 38 so that the connector is retained in a fixed, stable position. A foot and a mounting flange (not shown) may be joined to, or integrally formed with, connector 60, if so desired.

The connectors 44, 50 and 56 are executed in a metal, such as 16 gauge steel, that can be chrome plated, or otherwise treated, to a shiny, polished finish. The transparent sleeves for the illuminated modules may be made from several plastic materials, although acrylic plastics are preferred. As the door pull assemblies of FIG. 1 and the hand rail assembly of FIG. 2 illustrate, the instant connection system relies upon several connectors of different sizes and shapes to retain the opposite ends of adjacent illuminated modules in alignment. The feet and mounting flanges for the connectors insure that the connectors are firmly anchored and the transparent sleeves protect the neon tubes so that the structural assembly, such as the door pull, hand rail, etc. can be grasped by passengers riding in the elevator without damaging the gas filled tubes encased by the sleeves.

Figure 3:
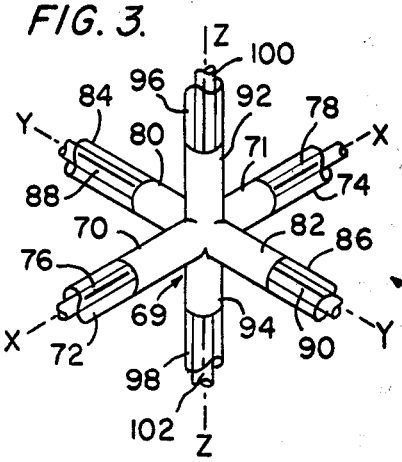
FIG. 3 is a perspective view of a six-way connector for joining together three pairs, or six, illuminated modules, only fragments of the modules being shown.

FIG. 3 is a perspective view of a six-way connector 69 with fragments of the illuminated modules being shown. The connector 69 includes a first pair of hollow arms 70,71 which extend away from the center of the connector along the x—x axis. The arms 70,71 receive, and align, the opposing ends of a pair of illuminated modules including sleeves 72,74 which encase therein gas filled tubes 76,78, respectively. The connector 69 also includes a second pair of hollow arms 80,82 which extend away from the center of the connector along the y—y axis. The arms 80,82 receive, and align, the opposing ends of a pair of illuminated modules including sleeves 84,86 which encase therein gas filled tubes 88,90, respectively. Furthermore, the connector includes a third pair of hollow arms 92,94 which extend away from the center of the connector along the z—z, or vertical, axis. The arms 92,94 receive, and align, the opposing ends of a pair of illuminated modules including sleeves 96,98 which encase therein gas filled tubes 100,102, respectively.

Connector 69 thus provides for the interconnection of a first pair of illuminated modules in the x—x axis, for the interconnection of a second pair of illuminated modules in the y—y axis, and for the interconnection of a third pair of illuminated modules in the z—z axis. The modules are interconnected by electrical cable passing through the hollow interior of the connector and thus not visible in FIG. 3. Since the connector hides the electrical cable, and since a highly polished, shiny metal is utilized for the connector, the neon tubes seem to blend together into a continuous illuminated line of light. Each pair of hollow arms, it should be noted, extends in a direction that is mutually perpendicular to the two other pairs of arms.

Figure 4:
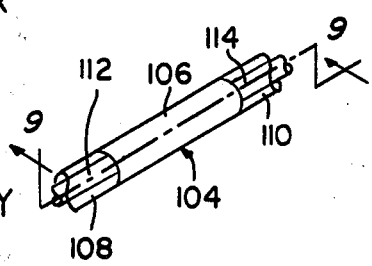
FIG. 4 is a perspective view of a two-way connector for joining together a pair of illuminated modules.

FIG. 4 is a perspective view of a two-way, straight-through connector 104 for joining together a pair of illuminated modules, which are shown in a fragmentary manner. Connector 104 consists of a hollow cylindrical metal tube 106 that receives, and aligns, the opposing ends of a pair of illuminated modules. The modules include sleeves 108,110, and gas filled tubes 112,114 are encased within sleeves 108,110, respectively. Tube 106 is formed of a metal with a shiny finish, and the electrical cable that interconnects tubes 112,114 is hidden within the interior of the tube.

Figure 5:
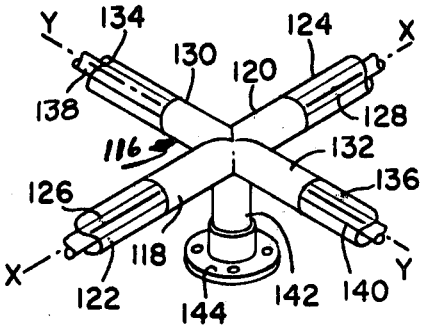
FIG. 5 is a perspective view of a four-way connector for joining together two pairs of illuminated modules, such view further showing a depending foot and mounting flange for the connector.

FIG. 5 is a fragmentary perspective view of a four-way connector 116. The connector comprises a first pair of hollow arms 118,120 that extend away from the body of the connector in the x—x axis; the opposing ends of a first pair of illuminated modules are received in, and aligned in, the hollow arms 118,120. The modules include sleeves 122,124 and gas filled tubes 126,128 are encased in the sleeves 122,124, respectively. A second pair of hollow arms 130,132 extend away from the body of the connector in the y—y axis. A second pair of illuminated modules including sleeves 134,136 are received in, and aligned in, the hollow arms 130,132. As previously noted, gas filled tubes 138,140 are encased in the sleeves 134,136, respectively. The electrical cables that interconnect the gas filled tubes are hidden in the hollow interior of the connector, thus enhancing the visual impact of the illuminated structural assembly utilizing the connector.

A foot 142 depends from the connector 116, and a mounting flange 144 is secured to the free end of the foot 142. Apertures are formed in the flange so that the flange may be nailed, bolted, screwed or otherwise secured to a support surface. The foot may be integrally formed with the connector, or may be secured thereto by known metal joining techniques.

Figure 6:
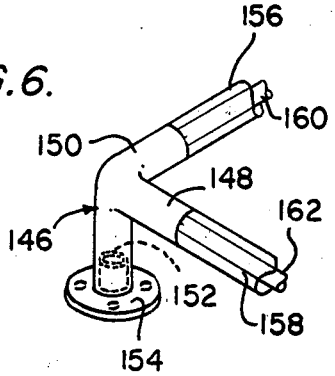
FIG. 6 is a perspective view of a two-way, right angled connector for joining together a pair of illuminated modules, such view further showing a depending foot and mounting flange for the connector.

FIG. 6 shows a two-way connector 146 for joining the adjacent ends of illuminated modules in a right angled relationship. Connector 146 includes a pair of perpendicularly extending hollow arms 148,150, as well as a depending foot 152. A mounting flange 154 is secured to the free end of foot 152 so that the connector 146 can be securely held in place relative to a support surface. The interior of connector 146 is hollow, and the electrical leads extending between the illuminated modules are hidden therewithin. The illuminated modules include rigid, transparent plastic sleeves 156,158 with gas filled tubes 160,162 encased therein.

Figure 7:
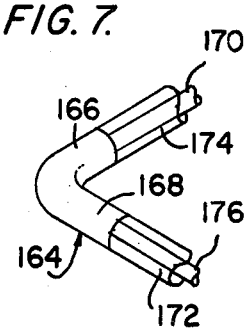
FIG. 7 is a perspective view of a two-way, right angled connector for joining together a pair of illuminated modules.

FIG. 7 illustrates a two-way, right-angled connector 164. The hollow tubular body of the connector defines a pair of arms 166,168 which receive opposite ends of adjacent illuminated modules. The modules include rigid, transparent plastic sleeves 170,172 which encase gass filled tubes 174,176, respectively.

Figure 8:
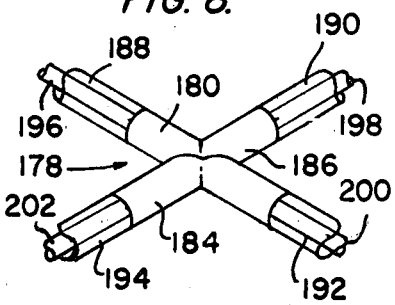
FIG. 8 is a perspective view of a four-way connector for joining together two pairs of illuminated modules.

FIG. 8 depicts another four-way connector 178 that is similar to the four-way connector 116 previously illustrated in FIG. 5. Connector 178, however, omits the depending foot 142 and mounting flange 144 employed by connector 116. Connector 178 includes a first pair of hollow arms 180,182 extending in a first direction, such as the y—y axis, and a second pair of hollow arms 184,186 extending in a second, perpendicular direction, such as the x—x axis. The four arms receive the sleeves for four illuminated modules therein, and the leads for interconnecting the modules are concealed within the body of the connector. The modules include transparent sleeves 188,190,192,194, which encase gas filled tubes 196,198,200 and 202, respectively.

Figure 9:
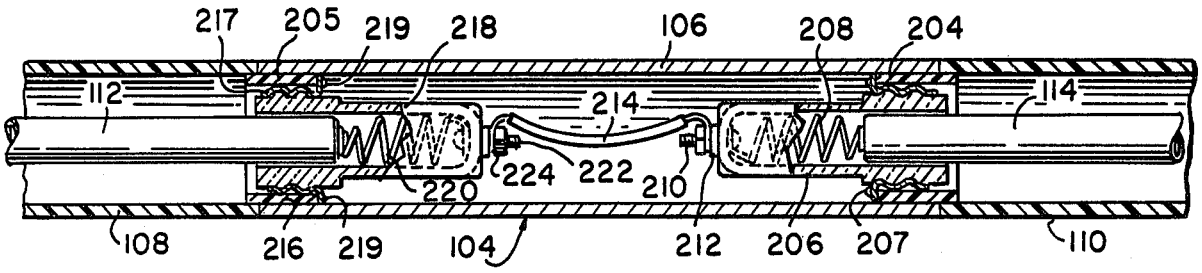
FIG. 9 is a cross-sectional view, on an enlarged scale, through the two-way connector of FIG. 4, such view being taken on the line 9—9 in FIG. 4 and in the direction indicated.
Figure 10:
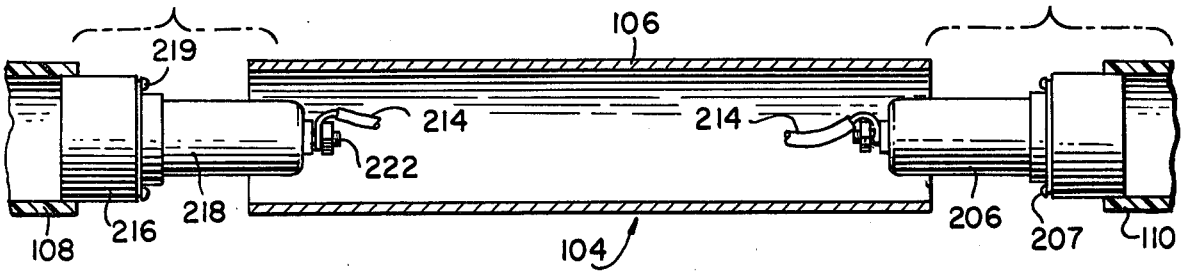
FIG. 10 is a view similar to FIG. 9, but showing the illuminated modules prior to insertion in the two-way connector.

FIGS. 9 and 10 show a representative connector 104 of the several connectors used to form an assembled configuration of illuminated modules. The opposing ends of a first and a second illuminated module are inserted into the opposite ends of the tubular body 106 of two-way, straight-through connector 104. The first illuminated module includes a transparent plastic sleeve 110 that encases a gas filled tube 114. The plastic sleeve 110 has a diameter equal to the diameter of tubular body 106. An annular collar 204 projects axially from sleeve 110. The collar 204 is slightly smaller in diameter than body 106, so that the collar can be inserted into sealing engagement with the body. The collar 204 may be made of plastic and can be integrally molded with the sleeve, or can be separately formed and adhesively secured thereto. An identical collar (not shown) projects axially from the opposite end of sleeve 110. A metal annulus 205 is secured within collar 204 by fasteners 207; the annulus is threaded.

An end housing 206 projects axially beyond collar 204 into the interior of hollow connector 106, when the threads on the housing are mated with the threads on annulus 205. The end housing is formed of pyrex or glass. The coil spring 208 for making electrical contact with the tube 114, and thus exciting the gas within the housing, extends through the housing. A threaded metallic post 210, with conductive nuts 212 adjustably mounted thereon, receives the electrical leads 214, which pass within the shielded cable. The leads 214, as best shown in FIG. 9, are concealed from view within the interior of the tubular body 106.

The second illuminated module includes a transparent plastic sleeve 108 that encases a gas filled tube 112. The plastic sleeve has a diameter equal to the diameter of tubular body 106. An annular collar 216 projects axially from sleeve 108. The collar 216 is slightly smaller in diameter than body 106, so that the collar can be inserted into sealing engagement with the body. A metal annulus 217 is secured within collar 216 by fasteners 219; the annulus is threaded. An identical collar (not shown) projects axially from the opposite end of sleeve 108. An end housing 218 projects axially beyond collar 216 into the interior of hollow connector 106, when the threads on the end cap are mated with the threads on annulus 217. The coil spring 220 for making electrical contact with the tube, and thus exciting the gas within the tube 112, extends through the housing. A threaded metallic post 222, with conductive nuts 224 mounted adjustably thereon, receives the electrical leads 214.

Figure 11:
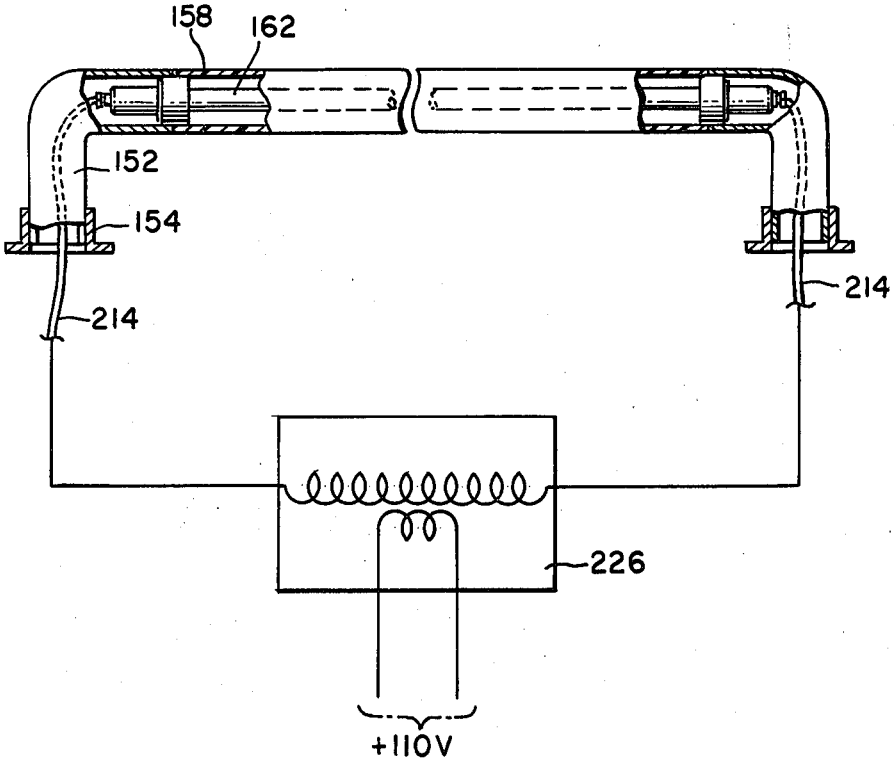
FIG. 11 is a schematic representation of the electrical circuit for energizing the plurality of illuminated modules.

FIG. 11 schematically represents the manner in which the plurality of illuminated modules are energized, in series, to excite the gas filled tubes. Alternating current, supplied at 110 volts, is stepped up by a known transformer 226 to the range of 3,000 to 15,000 volts, the voltage being dependent upon the number of modules utilized in the assembled configuration. The cable 214 is passed through the opening in the mounting flange, such as flange 154, secured to the foot 152 of a connector, such as the connector shown in FIG. 6. The cable is secured between the conductive nuts on the mounting post on the end housing of a gas filled tube, such as tube 162, encased within a sleeve 158. Several sleeves and connectors are joined together and a length of cable 214 extends between the adjacent ends of each gas filled tube. The cable 214 is passed through the depending foot of a connector and returned to transformer 226. The cable 214 is hidden from view at all times within the hollow interior of the connectors.

While a preferred embodiment of the instant connection system has been described in detail supra, various changes in the essential components of the system will undoubtedly occur to the skilled artisan. For example, the body of mounting flanges may fit within or without the depending feet of the connectors (as shown in FIG. 5 and FIG. 6), and the right angled connectors 50 may meet in sharp corners rather than being curved in the manner suggested in FIG. 2, and the connectors may have additional arms to receive eight or more illuminated modules. While the connectors and modules are joined together by a friction fit, the same components could be joined by a slot and key arrangement. Also, while the connector is executed in metal, a plastic, opaque connector might be feasible under certain conditions. Thus the appended claims should be broadly construed to encompass all minor variations that reasonably fall within the spirit of the claims in order to preserve for the inventor the rightful rewards of his labors.

I claim:

1. A connection system for mechanically and electrically joining a plurality of illuminated modules into a decorative lighting display; such system including:

(a) a plurality of light impervious rigid connectors with hollow tubular bodies, (b) each module comprising;

(I) a rigid transparent plastic sleeve, (II) a neon gas filled tube that extends axially through said plastic sleeve, (III) end caps secured to opposite ends of said plastic sleeve for receiving and retaining the neon filled tube in fixed position, (IV) electrically conductive members located on said end caps for delivering electrical energy to the neon gas to ignite same, and (V) means for retaining the end caps in position, (c) each connector securely receiving an end cap of at least one module therewithin, (d) electrical leads extending between end caps of adjacent modules, (e) a source of high voltage power for supplying the electrical leads with sufficient voltage to excite the neon filled tubes and cause decorative, low intensity light to radiate outwardly in all directions through said transparent sleeves, and (f) said leads being disposed entirely within the hollow tubular bodies of the light impervious connectors, whereby said leads are completely hidden from view.

2. A connection system as defined in claim 1 wherein said means for retaining the end caps in position are annular collars, the diameter of each collar being slightly less than the diameter of the tubular body of the connector so that the collar can be inserted into said tubular body and retained therewithin.

3. A connection system as defined in claim 1 wherein said end caps are formed of glass, and said conductive members include posts, nuts, coil springs and metal annuli which engage the end caps.

4. A connector system as defined in claim 1 wherein said connectors are fabricated from a metal with a shiny exterior surface.

* * * * *